US006667604B2

(12) United States Patent
Yanagisawa

(10) Patent No.: US 6,667,604 B2
(45) Date of Patent: Dec. 23, 2003

(54) POWER SUPPLY CIRCUIT WITH CONTINUED POWER GENERATION AFTER SWITCH TURN-OFF

(75) Inventor: Akihiro Yanagisawa, Toyohashi (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/199,095

(22) Filed: Jul. 22, 2002

(65) Prior Publication Data

US 2003/0020441 A1 Jan. 30, 2003

(30) Foreign Application Priority Data

Jul. 27, 2001 (JP) ..... 2001-227680

(51) Int. Cl.[7] ..... G05F 1/44
(52) U.S. Cl. ..... 323/274; 323/266; 323/303
(58) Field of Search ..... 323/273, 274, 323/275, 282, 284, 303, 266, 269

(56) References Cited

U.S. PATENT DOCUMENTS 4,536,699 A * 8/1985 Baker ..... 323/276
4,742,988 A 5/1988 Haneda et al. ..... 251/129.01
4,792,747 A * 12/1988 Schroeder ..... 323/303
6,084,384 A 7/2000 Kawamoto et al. ..... 323/269
6,320,363 B1 * 11/2001 Oglesbee et al. ..... 323/303
6,331,766 B1 * 12/2001 Kalpakjian et al. ..... 323/268
6,377,033 B2 * 4/2002 Hsu ..... 323/274

FOREIGN PATENT DOCUMENTS

JP A-10-225003 8/1998 ..... H02J/7/00
JP A-2001-175366 6/2001 ..... G06F/1/26

* cited by examiner

*Primary Examiner*—Bao Q. Vu
(74) *Attorney, Agent, or Firm*—Nixon & Vanderhye P.C.

(57) ABSTRACT

A power supply circuit includes a constant voltage circuit and a timer circuit. The constant voltage circuit generates a constant voltage by regulating a base current of the first transistor via the second transistor. The timer circuit includes a comparator, a delay circuit and an OR circuit. The comparator determines a condition of the IG switch, open or closed. The delay circuit delays inputting an output of the comparator for a predetermined period. The OR circuit outputs a signal to halt the constant voltage generation when the outputs of the comparator and delay circuits indicate that the IG switch is open. The timer circuit is used to continue the constant voltage generation for a predetermined period after the IG switch is opened.

6 Claims, 4 Drawing Sheets

POWER SUPPLY CIRCUIT WITH CONTINUED POWER GENERATION AFTER SWITCH TURN-OFF

CROSS REFERENCE TO RELATED APPLICATION

This application is based on and incorporates herein by reference Japanese Patent Application No. 2001-227680 filed on Jul. 27, 2001.

FIELD OF THE INVENTION

The present invention relates to a power supply circuit utilized for a vehicular control device and continues power generation after switch turn-off.

BACKGROUND OF THE INVENTION

In a power supply circuit used for a vehicular control device, large capacitance is required for an output capacitor in a constant voltage circuit. Moreover, connectors in the power supply circuit may cause problems due to inadequate connection.

A power supply circuit that counters the above problem is proposed in U.S. Pat. No. 6,084,384 (JP-A-11-266547). As shown in FIG. 4, this power supply circuit includes a battery 61, the first power supply line BATT, the second power supply line VB and a switching device 62, which includes an ignition switch. The first power supply line BATT is continuously supplied with power from the battery 61. The second power supply line VB is supplied with power from the battery 61 only when the switching device 62 is closed. A primary constant voltage circuit 63 is connected to the second power supply line VB and an auxiliary constant voltage circuit 64 is connected to the first power supply line BATT. The constant voltage circuits 63 and 64 supply power to the third power supply line DL.

The primary circuit 63 includes a transistor 63*a* and a constant voltage control IC 63*b*. The auxiliary circuit 64 includes a transistor 64*a* and a constant voltage control IC 64*b*. A halt control circuit 65 is provided to continue operations of the auxiliary circuit 64 for a predetermined period after power supply to the second power supply line VB is cut off.

In the power supply circuit, power is normally supplied from the primary circuit 63 to the third power supply line DL. After the switching device 62 is opened, the power is supplied from the auxiliary circuit 64 to the third power supply line DL. If the second power supply line VB is momentarily shut down, a constant voltage is supplied by the auxiliary circuit 64. The output voltage of the auxiliary circuit 64 is adjusted lower than that of the primary circuit 63.

However, when the power supply circuit is implemented on an IC chip, a voltage drop in output voltage may occur. When the switching device 62 is opened and constant voltage generation by the primary circuit 63 is halted, the auxiliary circuit 64 starts a constant voltage generation. During the period between the time that the switching device 62 is opened and the time that the auxiliary circuit 64 starts providing a sufficient voltage, a voltage drop may occur. The dropped voltage may trigger a low voltage reset.

As shown in FIG. 5, when the switching device 62 is switched from ON (closed) to OFF (opened), the primary circuit 63 enters the non-operating state and the auxiliary circuit 64 enters the operating state. It takes for a while until the output voltage of the auxiliary circuit 64 rises to a sufficient level. As a result, the output voltage of the power supply circuit drops during that period.

In some vehicular control devices, a plurality of constant voltage circuits are provided in a power supply circuit to generate constant voltages in each section. In recent years, the constant voltage is lowered to cut back power consumption of an onboard battery. For instance, a power supply circuit that produces different constant voltages for sensors and a CPU has been introduced. In such a power supply circuit, constant voltage generation for each constant voltage circuit is controlled by opening and closing a switching device such as an ignition switch. Since requirements for reduction in power consumption and for constant voltage variation will increase, it is preferable that the circuit configuration is more simplified.

SUMMARY OF THE INVENTION

The present invention therefore has an objective to provide a power supply circuit that implements desired constant voltage generation with a simple configuration.

The present invention has another objective to simplify the configuration of the power supply circuit that outputs a variety of constant voltages.

The power supply circuit of the present invention includes a constant voltage circuit provided in a power supply line that is continuously supplied with power from a power source. When a power supply switching device is closed, the constant power supply circuit performs constant voltage generation. The power supply circuit also includes a timer circuit. The timer circuit controls the constant voltage circuit to continue the constant voltage generation for a predetermined period (allowable period) after the switching device is opened.

If an instantaneous power interruption occurs and the interrupted period is shorter than the allowable period, the constant voltage generation continues. Therefore, the constant voltage is outputted without interruption. When the interrupted period reaches the allowable period, the constant voltage generation is halted.

The power supply circuit of the present invention does not require a large-capacitance output capacitor to handle the instantaneous power interruption. Since the power supply circuit of the present invention does not require the switching, the voltage drop is prevented. Therefore, a desired constant voltage generation by the simple power supply circuit is possible.

BRIEF DESCRIPTION OF THE DRAWINGS

The above and other objectives, features and advantages of the present invention will become more apparent from the following detailed description made with reference to the accompanying drawings. In the drawings.

DETAILED DESCRIPTION OF THE PREFERRED EMBODIMENT

The preferred embodiments of the present invention will be explained with reference to the accompanying drawings.

[First Embodiment]

Figure 1:
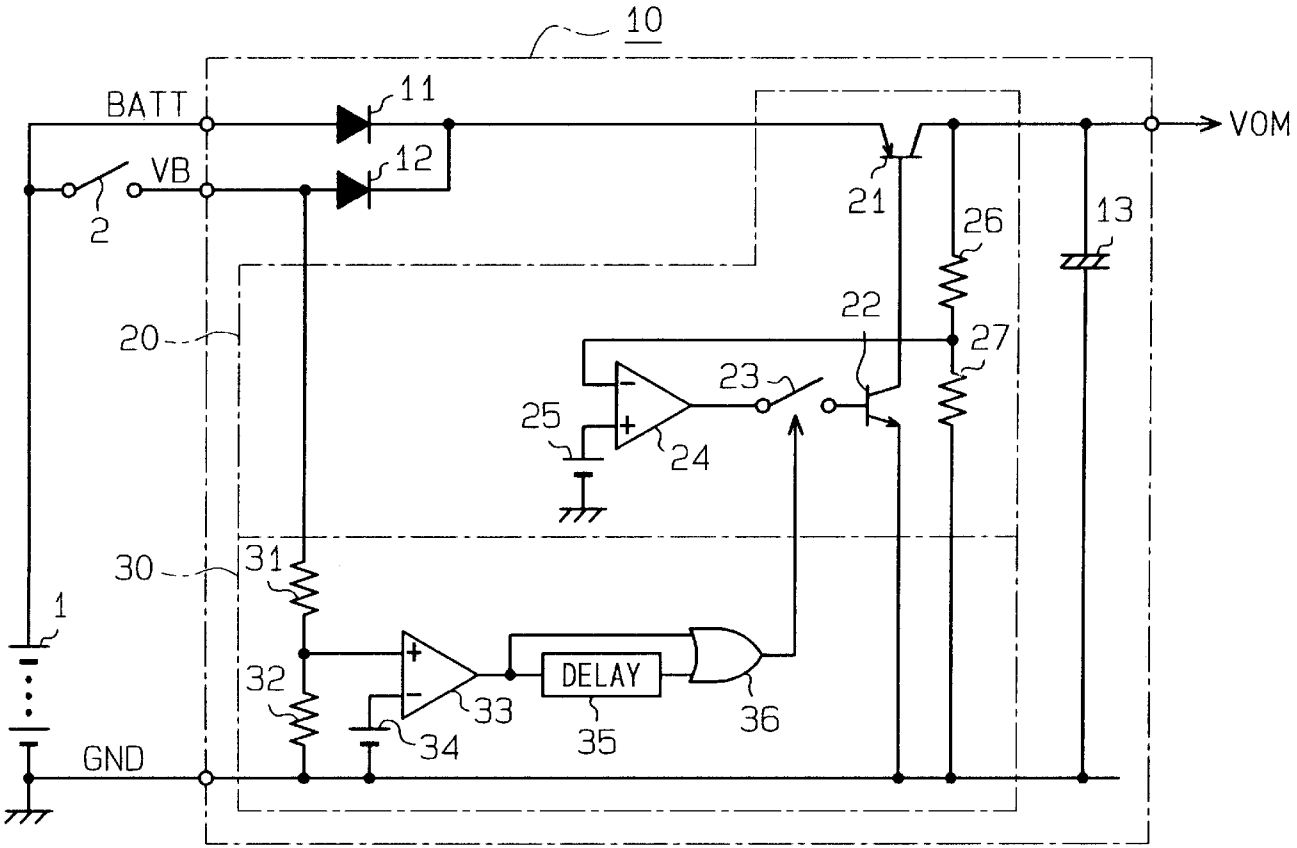
FIG. 1 is a circuit diagram showing a power supply circuit according to the first embodiment of the present invention.

Referring to FIG. 1, a power supply circuit 10 is directly connected to a battery 1 to be continuously supplied with power from the battery 1 via the first power supply line BATT. It is also connected to the battery 1 through an ignition (IG) switch 2 to be supplied with power from the battery 1 via the second power supply line VB only when the IG switch 2 is closed. The IG switch 2 is a power supply switching device and can be other types of switching device such as a relay.

The power supply circuit 10 includes a constant voltage circuit 20 and a timer circuit 30. A power voltage is inputted to the constant voltage circuit 20 via a diode 11 in the first line BATT or a diode 12 in the second line VB. Then, the constant voltage circuit 20 generates a predetermined constant voltage VOM (e.g., 5 V). An output capacitor 13 is provided for the constant voltage circuit 20.

The constant voltage circuit 20 includes a pnp transistor 21 and a npn transistor 22. The pnp transistor 21 is connected in the first line BATT. The npn transistor 22 is connected to the base of the pnp transistor 21. The constant voltage VOM is generated by regulating a base current of the transistor 21 via the transistor 22. An output terminal of an operational amplifier 24 is connected to the base of the transistor 22 via a switch 23. Non-inverting and inverting terminals of the amplifier 24 are connected to a reference voltage supply 25 and a middle point of a voltage divider comprising resistors 26 and 27, respectively. The resistors 26 and 27 are utilized to feed back a fraction of the constant voltage VOM to the amplifier 24.

The timer circuit 30 includes a voltage divider constructed of resistors 31 and 32. The voltage divider is connected to the second line VB. Non-inverting and inverting terminals of a comparator 33 are connected to a middle point of the voltage divider and a reference voltage supply 34, respectively. An output of the comparator 33 is divided into two; one is directly inputted to an OR circuit 36 and the other is inputted to the OR circuit 36 via a delay circuit 35. The switch 23 is opened or closed based on an output of the OR circuit 36. In other words, constant voltage generation is controlled by the output of the OR circuit 36.

The delay circuit 35 delays inputting an output signal of the comparator 33 to the OR circuit 36 for a certain period of time. A conventional circuit such as a flip-flop can be used for the delay circuit 35. A delay time THD of the delay circuit 35 is set based on an instantaneous interruption tolerance dose or a capacity of the output capacitor 13. The comparator 33 corresponds to a determination circuit for determining a condition of the switch 23 (open or closed). The OR circuit corresponds to a logic circuit that outputs a signal to halt constant voltage generation.

Figure 2:
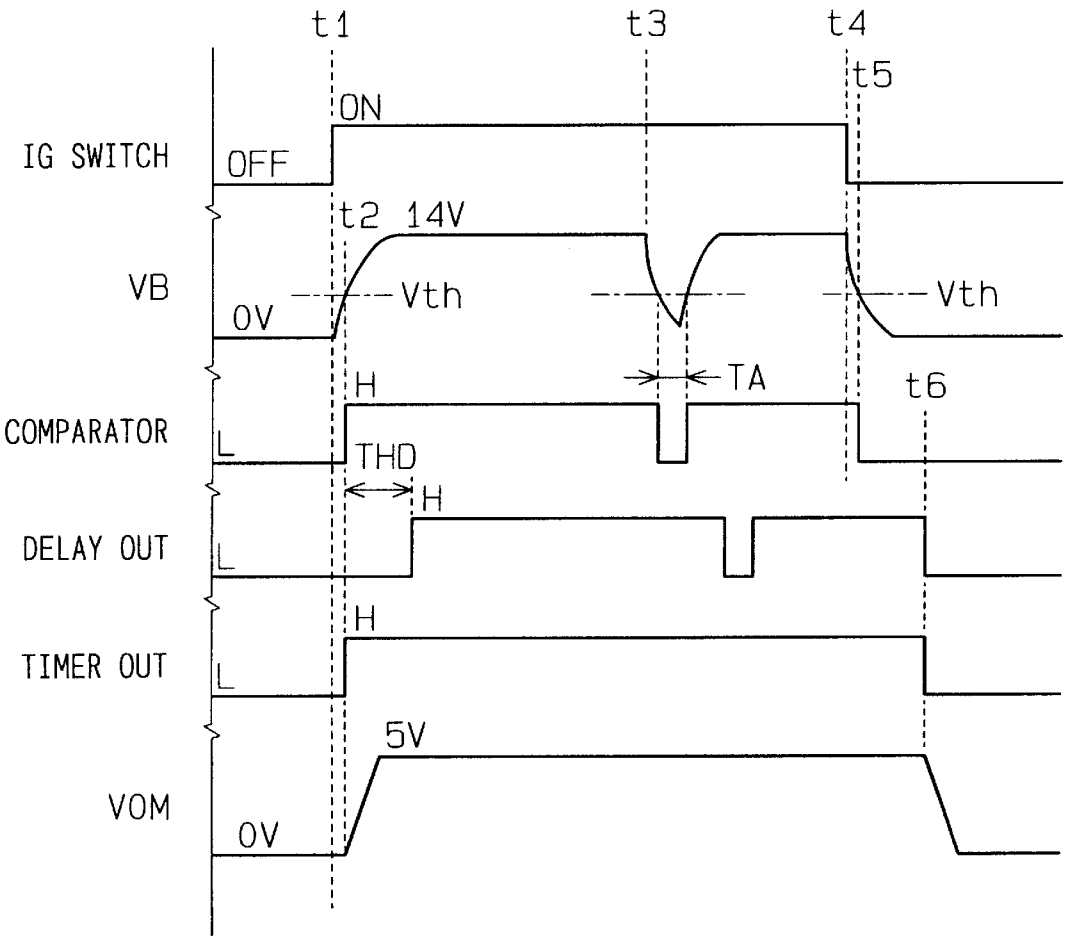
FIG. 2 is a timing chart showing operations of the power supply circuit according to the first embodiment of the present invention.

Referring to FIG. 2, the IG switch 2 is assumed to switch from OFF to ON and the voltage VB starts to increase from 0 V to 14 V at time t1. At time t2, the voltage VB reaches a threshold voltage Vth. As a result, a voltage measured at the non-inverting terminal of the comparator 33 exceeds the reference voltage and the output of the comparator 33 becomes high (H). At time t2, the output of the timer circuit 30 (OR circuit 36) becomes high (H). Because of this high signal, the switch 23 is closed and the constant voltage VOM starts rising to a higher level. The timing at which the output of the delay circuit 35 rises is later by the delay time THD (e.g., 20 msec) than the timing at which the output of the comparator 33 rises.

It is assumed that at time t3, the voltage VB is instantaneously interrupted due to the IG switch or power supply terminal connector having a connection failure. During the period of TA, the output of the comparator 33 becomes low. If the instantaneous power interruption is temporary and the period TA is shorter than the delay time THD, the output of the timer circuit 30 remains high and the constant voltage VOM generation continues.

When the IG switch switches to OFF at time t4, the voltage VB decreases. When the voltage VB becomes lower than the threshold voltage Vth at the time t5, the output of the comparator 33 becomes low. At the time t6, which is later by the delay time THD than the time t5, the outputs of the delay circuit 35 and timer circuit 30 become low. Because of this low signal, the switch 23 switches to OFF and the constant voltage generation is halted. Therefore, the constant voltage VOM falls to a low level.

In FIG. 2, the same threshold voltage Vth is used in both cases that the voltage VB is rising and falling for expediency. In real application, the threshold voltage Vth preferably has hysteresis. It is preferable to switch the threshold voltage Vth to a lower level for the rising voltage and to a lower lever for the falling voltage.

The power supply circuit 10 does not require a large-capacitance output capacitor to counter to the instantaneous power interruption.

The two power supply lines BATT and VB are provided to supply the battery voltage to the constant voltage circuit 20 via the diodes 11 and 12. This makes the power supply circuit 10 highly reliable.

[Second Embodiment]

Figure 3:
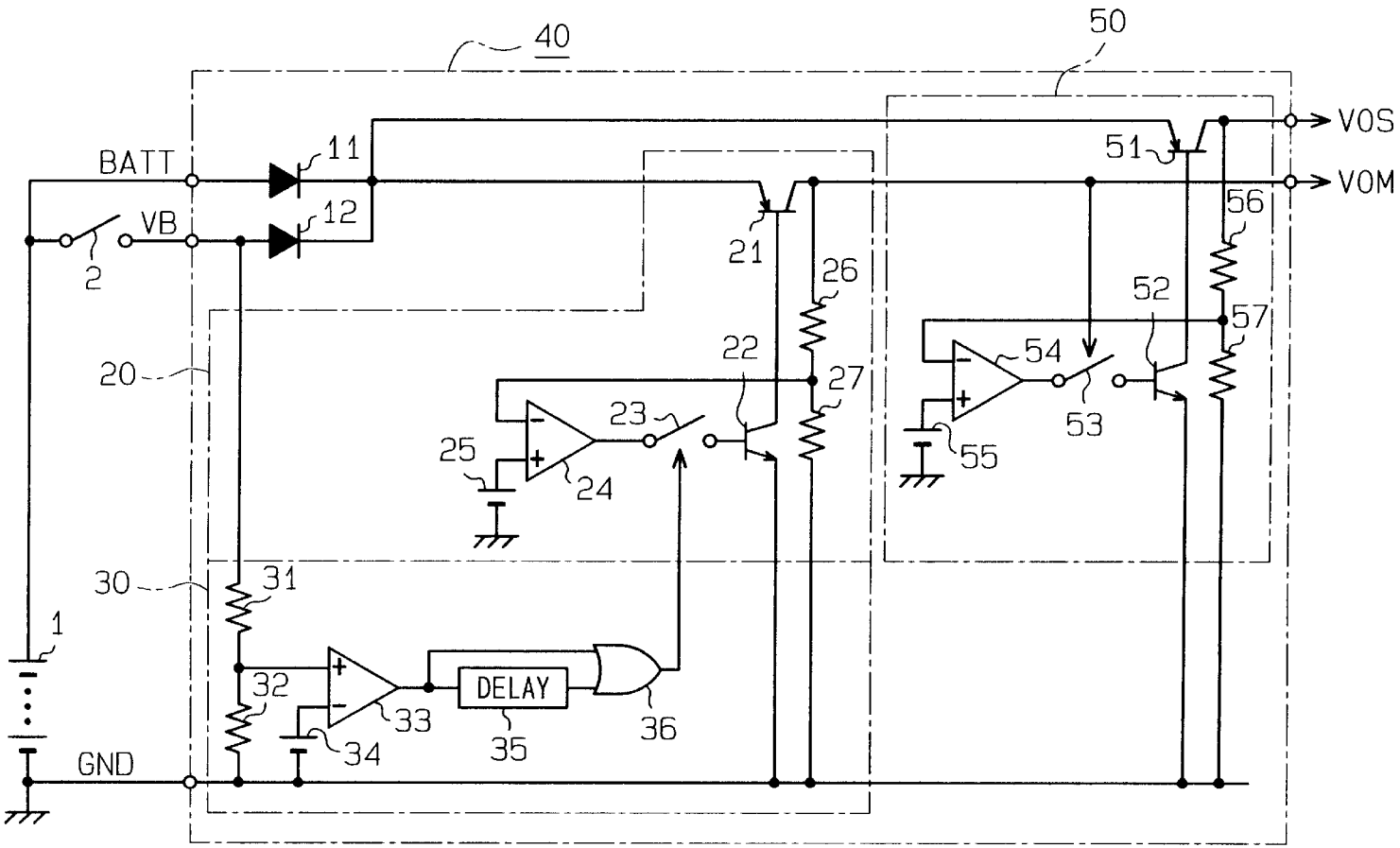
FIG. 3 is a circuit diagram showing a power supply circuit according to the second embodiment of the present invention.
Figure 4:
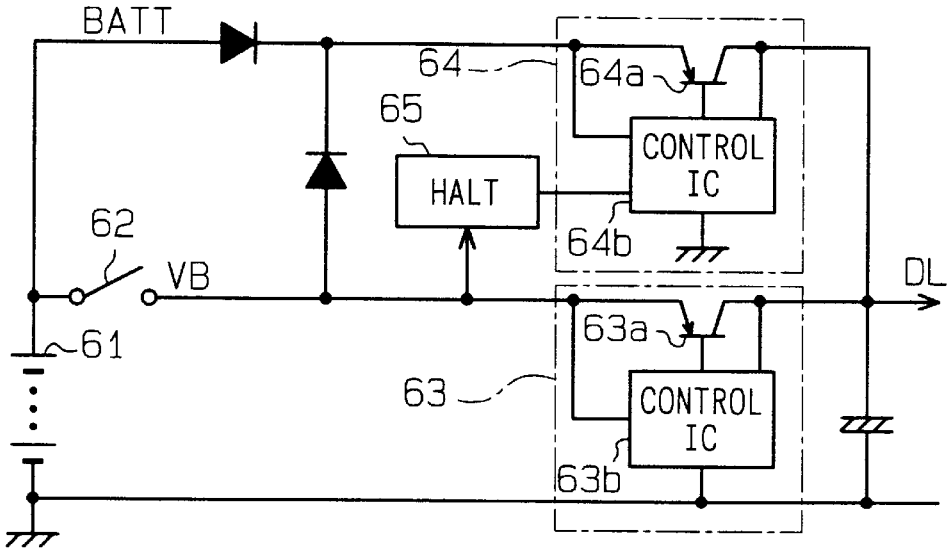
FIG. 4 RELATED ART
FIG. 4 is a circuit diagram showing a power supply circuit according to the related art.
Figure 5:
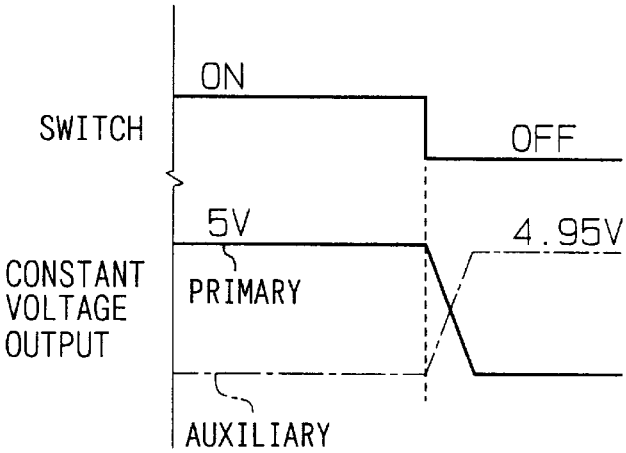
FIG. 5 RELATED ART
FIG. 5 is a timing chart showing a voltage drop occurring in the power supply circuit of the related art.

Referring to FIG. 3, a power supply circuit 40 has the same configuration as the power supply circuit 10 of the first embodiment except for a constant voltage circuit 50. The first constant voltage circuit 20 generates the first constant voltage VOM (5 V) and the second constant voltage circuit 50 generates the second constant voltage VOS (3.3 V). The output capacitors for the constant voltage circuits 20 and 50 are not shown in FIG. 3 for convenience.

A power supply voltage necessary for constant voltage generation is inputted to the first and second constant voltage circuits 20 and 50. The voltage is inputted to the circuit 20 and 50 via a power supply line BATT that is continuously supplied with power from the battery 1.

The constant voltage circuit 50 has a pnp transistor 51 and a npn transistor 52. The transistor 51 is connected in the first power supply line BATT and the transistor 52 is connected to the base of the transistor 51. A constant voltage VOS (3.3 V) is generated by regulating a base current of the transistor 51 via the transistor 52. An output terminal of an operational amplifier 54 is connected to the base of the transistor 52 via a switch 53. A constant voltage supply is connected to the non-inverting terminal of the amplifier 54. A middle point of the voltage divider constructed of resistors 56 and 57 is connected to the inverting terminal of the amplifier 54.

The switch 53 is opened or closed based on the constant voltage VOM outputted from the constant voltage circuit 20. If VOM=5 V, the switch 53 is closed and the constant voltage VOS is generated. If VOM=0 V, the switch 53 is opened and the generation of constant voltage VOS is halted.

In this embodiment, start and halt of the constant voltage generation by the constant voltage circuit 50 are appropriately controlled by the constant voltage VOM. Complicated configuration is not required to determine whether the constant voltage generation needs to be started or halted. Therefore, the power supply circuit 40 has simple configuration even though it outputs multiple constant voltages.

Since the power supply circuit 40 has the timer circuit 30, the constant voltage generation continues in the case of instantaneous power interruption. The constant voltage circuit 50 can also have the same function. The power supply circuit does not require a complicated configuration to provide desired constant voltage generation.

The present invention should not be limited to the embodiment previously discussed and shown in the figures, but may be implemented in various ways without departing from the spirit of the invention. For instance, the constant voltages (first and second constant voltages) VOM and VOS can be the same voltages or different voltages. The constant voltage VOS can be more than one. In this case, a plurality of the constant voltage circuits having the same configuration as the constant voltage circuit 50 is provided as required. Start and halt of constant voltage generation by the constant voltage circuits are controlled based on the constant voltage VOM.

In FIGS. 1 and 3, the power supply lines BATT and VB are connected to the diodes 11 and 12. The configuration can be modified as long as power required for constant voltage generation is supplied to the constant voltage circuit 20 via the first line BATT.

What is claimed is:

1. A power supply circuit for a power supply system having a power source, a power supply line that is continuously supplied with power from the power source, a power supply switching means, the power supply circuit comprising:

a constant voltage circuit provided in the power supply line to generate a constant voltage when the power supply switching means is closed; and a timer circuit that inputs a voltage when the power supply switching means is closed, wherein the timer circuit is constructed to continue constant voltage generation of the constant voltage circuit for a predetermined period after the power supply switching means is opened, then to halt the constant voltage generation.

2. The power supply circuit as in claim 1, wherein the timer circuit comprises:

a determination circuit that determines a condition of the power supply switching means;

a delay circuit that delays inputting an output of the determination circuit for a predetermined period; and a logic circuit that outputs a signal to disable the constant voltage generation of the constant voltage circuit when the outputs of the determination circuit and delay circuit both indicate a closure of the power supply switching means.

3. The power supply circuit as in claim 1, further comprising:

another power supply line that is supplied with power from the power source via the power supply switching means; and diodes connected in each power supply line, wherein a power supply voltage for constant voltage generation is inputted to the constant voltage circuit through at least one of the power supply lines via the diodes.

4. A power supply circuit for a power supply system having a power source, a power supply line that is continuously supplied with power from the power source, a power supply switching means, the power supply circuit comprising:

a first constant voltage circuit that performs a constant voltage generation when the power supply switching means is closed and outputs a first constant voltage; and a second constant voltage circuit connected in the power supply line and outputs a second constant voltage, wherein an operation of the second constant voltage circuit is determined based on the first constant voltage inputted form the first constant voltage circuit to the second constant voltage circuit.

5. The power supply circuit as in claim 4, further comprising:

a timer circuit to which a voltage corresponding to the condition of the power supply switching means is inputted, wherein the timer circuit is constructed to continue constant voltage generation of the first constant voltage circuit for a predetermined period after the power supply switching means is opened, then to halt the constant voltage generation.

6. The power supply circuit as in claim 4, wherein a power supply voltage for the constant voltage generation is inputted to the first and second constant voltage circuits via the power supply line that are continuously supplied with power from the power source.

* * * * *